US009774943B1

(12) United States Patent
Weitzner

(10) Patent No.: US 9,774,943 B1
(45) Date of Patent: Sep. 26, 2017

(54) EAR BUD STABILIZER

(71) Applicant: Jason M. Weitzner, Naples, FL (US)

(72) Inventor: Jason M. Weitzner, Naples, FL (US)

(73) Assignee: BPLUGZ, LLC, Naples, FL (US)

( * ) Notice: Subject to any disclaimer, the term of this patent is extended or adjusted under 35 U.S.C. 154(b) by 0 days.

(21) Appl. No.: 14/996,365

(22) Filed: Jan. 15, 2016

(51) Int. Cl.
*H04R 25/00* (2006.01)
*H04R 1/10* (2006.01)
*H04R 5/033* (2006.01)

(52) U.S. Cl.
CPC ..... *H04R 1/105* (2013.01); *H04R 1/1075* (2013.01); *H04R 5/0335* (2013.01)

(58) Field of Classification Search
USPC ..... 381/376, 372, 378, 379; 2/209; 181/129
See application file for complete search history.

(56) References Cited

U.S. PATENT DOCUMENTS

| | | | | |
|---|---|---|---|---|
| 2,671,221 | A | 3/1954 | Triplett | |
| 2,672,864 | A | 3/1954 | Makara | |
| 4,554,993 | A | 11/1985 | Houng | |
| 4,669,129 | A * | 6/1987 | Chance | H04R 1/1008 181/129 |
| 5,835,609 | A | 11/1998 | LeGette et al. | |
| 6,880,174 | B2 | 4/2005 | Prokop | |
| D541,482 | S | 4/2007 | LeGette et al. | |
| 7,210,173 | B2 | 5/2007 | Bavetta et al. | |
| D545,001 | S | 6/2007 | LeGette et al. | |
| 8,325,961 | B2 | 12/2012 | LeGette et al. | |
| 8,443,466 | B2 | 5/2013 | Tipp | |
| 8,503,688 | B2 | 8/2013 | DiRusso | |
| 8,713,714 | B2 | 5/2014 | Isom et al. | |
| 2005/0034216 | A1 * | 2/2005 | Le Gette | A61F 11/14 2/209 |
| 2005/0036643 | A1 * | 2/2005 | Le Gette | H04R 1/06 381/370 |
| 2008/0307562 | A1 * | 12/2008 | Tipp | A61F 11/14 2/209 |
| 2009/0022352 | A1 | 1/2009 | Weibel | |
| 2012/0131732 | A1 | 5/2012 | Bavetta et al. | |

FOREIGN PATENT DOCUMENTS

| | | |
|---|---|---|
| CN | 2465432 | 12/2001 |
| KR | 20-2003-0005045 | 5/2003 |

* cited by examiner

*Primary Examiner* — Sunita Joshi
(74) *Attorney, Agent, or Firm* — Livingston Loeffler, P.A.; Edward M. Livingston, Esq.; Bryan L. Loeffler, Esq.

(57) ABSTRACT

An ear bud stabilizer (1) that is worn on an individual's head over a pair of ear buds (18) to prevent the ear buds from falling out of the wearer's ears and to provide better sound quality from the ear buds. The ear bud stabilizer has a substantially C-shaped band (2) with ear covers (7A, 7B) each having a mesh covering (8) located thereon. The C-shaped band is preferably constructed from a resilient material that pushes the ear covers toward each other, thereby providing an inward pressure on the user's ears. The mesh coverings allow air circulation within the user's ears while performing activities, thereby preventing sweat from collecting in the user's ears.

16 Claims, 2 Drawing Sheets

EAR BUD STABILIZER

FIELD OF THE INVENTION

This invention relates to ear buds worn to listen to music and other audio, and more particularly, a stabilizer that is worn on an individual's head to prevent the ear buds from falling out of the wearer's ears and to provide better sound quality from the ear buds.

BACKGROUND OF THE INVENTION

Ear buds are small headphones that are fitted directly into the outer ear facing the ear canal. Earphones are portable and convenient, but many people consider them to be uncomfortable and prone to falling out. This is due to the fact that ear buds rest in the ear and there is no inward pressure being applied to hold the ear buds in wearer's ears, thus, the ear buds fall out during exercise and other activities, especially when the wearer is sweating. Every time the ear buds fall out, the individual must stop his or her activity and reinsert the ear bud. This can also be dangerous as a loose ear bud may become tangled in exercise equipment or become caught on other objects around the individual during an activity.

In addition, ear buds provide very little acoustic isolation and leave room for ambient noise to seep in. This problem is also due to the fact that ear buds rest in the ear and there is no inward pressure being applied to hold the ear buds in wearer's ears that will create a constant seal between the ear buds and the wearers ear canal. To overcome this problem, users may turn up the volume dangerously high to compensate which can obviously result in hearing damage.

Therefore, a need exists for a stabilizer that is worn on an individual's head to prevent the ear buds from falling out of the wearer's ears and to provide better sound quality from the ear buds.

The relevant prior art includes the following references:

| Patent No. | Inventor | Issue/Publication Date |
|---|---|---|
| (U.S. Patent References) | | |
| 2,671,221 | Triplett | Mar. 09, 1954 |
| 2,672,864 | Makara | Mar. 23, 1954 |
| 4,554,993 | Houng | Nov. 26, 1985 |
| 5,835,609 | LeGette et al. | Nov. 10, 1998 |
| 6,880,174 | Prokop | Apr. 19, 2005 |
| D541,482 | LeGette et al. | Apr. 24, 2007 |
| 7,210,173 | Bavetta et al. | May 1, 2007 |
| D545,001 | LeGette et al. | Jun. 19, 2007 |
| 2009/0022352 | Weibel | Jan. 22, 2009 |
| 2012/0131732 | Bavetta et al. | May 31, 2012 |
| 8,325,961 | LeGette et al. | Dec. 4, 2012 |
| 8,443,466 | Tipp | May 21, 2013 |
| 8,503,688 | DiRusso | Aug. 6, 2013 |
| 8,713,714 | Isom et al. | May 6, 2014 |
| (Foreign Patent References) | | |
| CN2465432 | N/A | Dec. 12, 2001 |
| 20-2003-0005045 | Kim | May 19, 2003 |

SUMMARY OF THE INVENTION

The primary object of the present invention is to provide a stabilizer that is worn on an individual's head over a pair of ear buds to prevent the ear buds from falling out of the wearer's ears.

An additional object of the present invention is to provide a stabilizer that is worn on an individual's head over a pair of ear buds to provide better sound quality from the ear buds.

An additional object of the present invention is to provide a stabilizer that is worn on an individual's head over a pair of ear buds that is comfortable to wear.

An additional object of the present invention is to provide a stabilizer that is worn on an individual's head over a pair of ear buds that provide air circulation to the ear to prevent sweat accumulation via air flow and ventilation of the product.

The present invention fulfills the above and other objects by providing an ear bud stabilizer having a substantially C-shaped band having an inner surface, an outer surface a right side end and a left side end. Ear covers extend from the right side end and the left side end, respectively, of the C-shaped band. Each ear cover is covered with a mesh covering or similar webbed or net material stretched across an opening that is defined by a curved frame. The covering is preferably a pliable material that conforms to the ear for comfort. The C-shaped band is preferably constructed from a resilient material that pushes the ear covers toward each other, thereby providing an inward pressure on the user's ears.

To use the ear bud stabilizer of the present invention, a user places and/or inserts a pair of ear buds into his or her ears. Then the user pulls the ear covers apart and places the ear covers over his or her ears and the ear buds. The resilient material of the C-shaped band then provides inward pressure on the ear buds, thereby preventing the ear buds from falling out of the user's ears and creating a seal between the ear buds and the user's ear canal to prevent ambient noise from interfering with the sound being emitted by the ear buds.

The mesh coverings allow air circulation with the user's ears while performing activities, thereby preventing sweat from collecting in the user's ears. By providing air circulation, the mesh coverings allow heat to escape from the user's ears. This is in contrast to conventional "ear muff" style ear warmers, which are used to keep a user's ears warm. It is not an object of this invention to provide warmth to the ears, to keep an individual's ears warm or to protect an individual's ears from the elements.

The mesh covering may be stretched across the curved frame so that it is flat or planar when in a resting position. Alternatively, the mesh material may have an interior surface that is convex or have a spacer located centrally thereon so that the interior surface of the mesh pushes into the ear, thereby further securing the ear buds within the user's ears.

Additional features of the present invention may include a size-adjustable C-shaped band having two sections wherein a right side portion is slidably coupled to a left side portion. In addition, the ear covers may be pivotally coupled to the C-shaped band to allow for adjustment to an individual user's ears and head. Alternatively, the C-shaped band and curved frames of the ear covers may be integrated into a single monolithic frame.

In addition, the mesh covers may provide a surface to print designs, such as logos.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
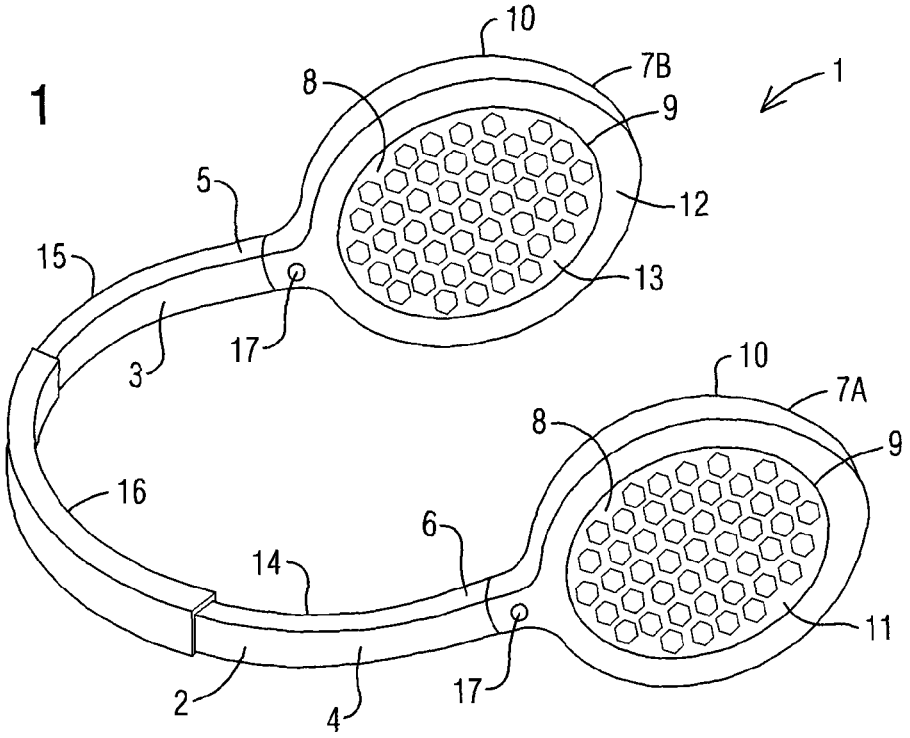
FIG. 1 is a left side perspective view of an ear bud stabilizer of the present invention.
Figure 2:
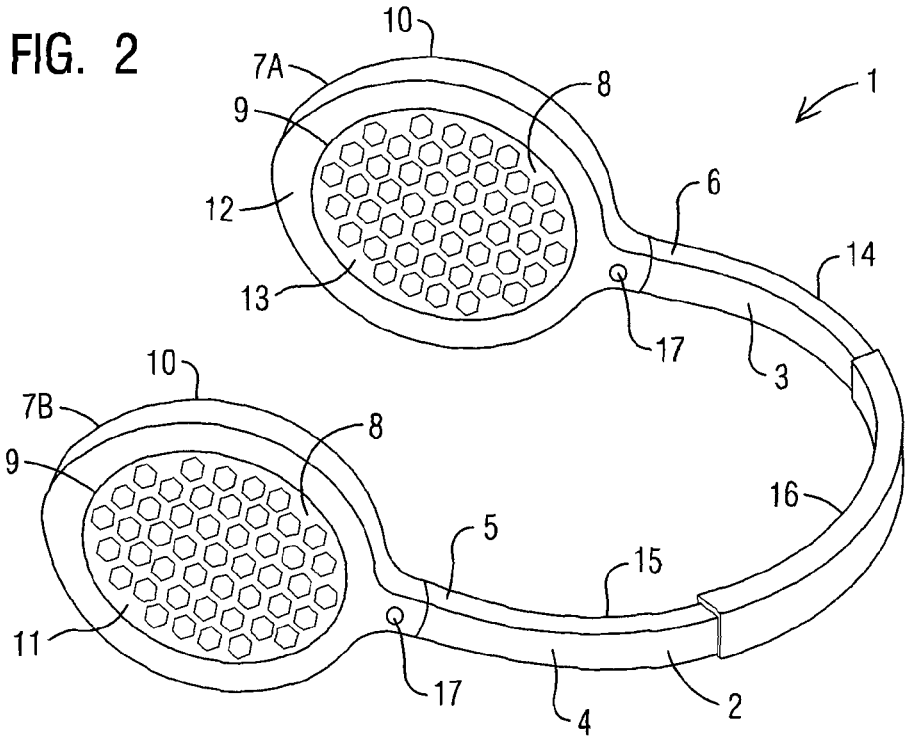
FIG. 2 is a right side perspective view of an ear bud stabilizer of the present invention.

For purposes of describing the preferred embodiment, the terminology used in reference to the numbered accessories in the drawings is as follows:

1. ear bud stabilizer
2. C-shaped band
3. inner surface of C-shaped band
4. outer surface of C-shaped band
5. right side end of C-shaped band
6. left side end of C-shaped band
7A. right side ear cover
7B. left side ear cover
8. mesh covering of ear cover
9. opening of ear cover
10. curved frame of ear cover
11. outer surface of ear cover
12. inner surface of ear cover
13. interior surface of mesh covering
14. right portion of C-shaped band
15. left portion of C-shaped band
16. sliding coupling
17. pivoting coupling
18. ear bud With reference to FIGS. 1 and 2, a left side perspective view and a right side perspective view, respectively, of an ear bud stabilizer 1 of the present invention is illustrated. The ear bud stabilizer 1 of the present invention comprises a substantially C-shaped band 2 having an inner surface 3, an outer surface 4 a right side end 5 and a left side end 6. A right side ear cover 7A and a left side ear cover 7B extend from the right side end 5 and a left side end 6, respectively, of the C-shaped band 2. Each ear cover 7A and 7B is covered with a mesh covering 8 or similar webbed material, net material and so forth that is stretched across an opening 9 defined by a curved frame 10. Each ear cover 7A and 7B comprises an outer surface 11 and an inner surface 12. The inner surface 12 is the surface that presses against a user's head and/or ear when the ear bud stabilizer 1 is worn. The mesh covering 8 may be stretched across the curved frame 10 so that the mesh covering 8 is flat or planar when in a resting position. The curved frame 10 may comprise an open frame or a closed circular or oval-shaped frame. Alternatively, the mesh coverings 8 may each have an interior surface 13 that is convex or have a spacer located centrally thereon so that the interior surfaces 13 of the mesh coverings 8 pushes into the user's ear, thereby further securing the ear buds within the user's ears.

The mesh covering 8 may be stretched across the opening 9 defined by the curved frame 10 by extending the mesh covering from an inner perimeter of the curved frame 10 (so the mesh covering 8 is completely flush with the inner surface 12 of the curved frame 10), a midline of the curved frame 10 (so the mesh covering 8 is located between the inner surface 12 and the outer surface 11 of the curved frame 10), or an outer perimeter of the curved frame 10 (so the mesh covering 8 is completely flush with the outer surface 11 of the curved frame 10). In addition, the curved frame 10 may be substantially-triangular-shaped so that the mesh covering 8 extends from apex.

Figure 4:
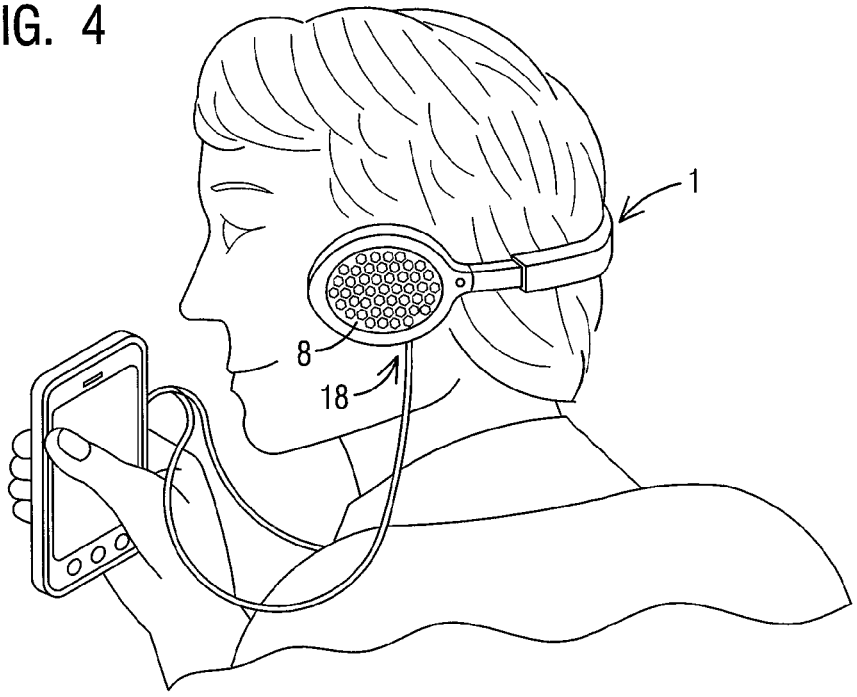
FIG. 4 is a side view of an ear bud stabilizer of the present invention in use.

The C-shaped band 2 is preferably constructed from a resilient material that pushes the inner surfaces 12 of the ear covers 7A and 7B toward each other, thereby holding the ear bud stabilizer 1 on a user's head and providing an inward pressure on the user's ears and ear buds, as illustrated in FIG. 4. In addition, the C-shaped band 2 may have two sections wherein a right portion 14 attached to the left portion 15 via a sliding coupling 16. In addition, the ear covers 7A and 7B may attached to the C-shaped band 2 via pivoting couplings 17 to allow for adjustment to an individual user's ears and head. Alternatively, the C-shaped band 2 and curved frames 10 of the ear covers 7A and 7B may be integrated into a single monolithic frame.

Figure 3:
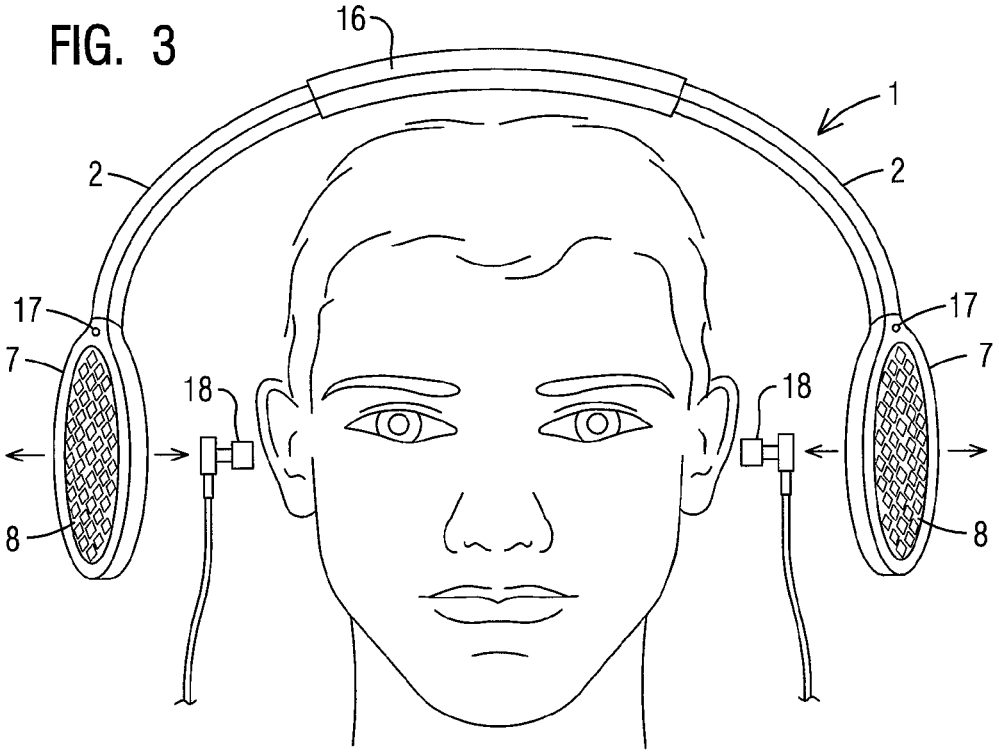
FIG. 3 is an exploded top view of an ear bud stabilizer of the present invention being stretched outward from a resting position into an open position over a pair of ear buds.

With reference to FIGS. 3 and 4, an exploded top view of an ear bud stabilizer 1 of the present invention being stretched outward from a resting position into an open position over a pair of ear buds 18 and a side view of an ear bud stabilizer 1 of the present invention in use, respectively, are illustrated. To use the ear bud stabilizer 1 of the present invention, a user places and/or inserts a pair of ear buds 18 into his or her ears. Then the user pulls the ear covers 7 apart, as illustrated in FIG. 3, and places the ear covers 7 over his or her ears and the ear buds 18. The resilient material of the C-shaped band 2 provides inward pressure on the ear buds 18, thereby preventing the ear buds 18 from falling out of the user's ears. In addition, the inward pressure on the ear buds 18 creates a seal between the ear buds 18 and the user's ear canal to prevent ambient noise from interfering with the sound being emitted by the ear buds 18. The mesh covering 8 allows air circulation with the user's ears while the user is performing activities, thereby preventing sweat from collecting in the outer parts of the user's ears.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. An ear bud stabilizer comprising:

a substantially C-shaped band having an inner surface, an outer surface a right side end and a left side end;

a right side ear cover extending from the right side end;

said right side ear cover comprising a curved frame defining an opening with a single layer of exposed mesh covering extending from the curved frame over the opening to allow for unimpeded air flow through the single layer of exposed mesh covering;

a left side ear cover extending from the left side end; and said left side ear cover comprising a curved frame defining an opening with a single layer of exposed mesh covering extending from the curved frame over the opening to allow for unimpeded air flow through the single layer of exposed mesh covering.

2. The ear bud stabilizer of claim 1 wherein:

the C-shaped band is constructed from a resilient material that pushes the right side ear cover and the left side ear cover.

3. The ear bud stabilizer of claim 1 wherein:

the curved frame of the right side ear cover is a closed frame; and the curved frame of the left side ear cover is a closed frame.

4. The ear bud stabilizer of claim 1 wherein:

the curved frame of the right side ear cover is an open frame; and the curved frame of the left side ear cover is an open frame.

5. The ear bud stabilizer of claim 1 wherein:

the mesh covering of the right side ear cover is a planar surface; and the mesh covering of the left side ear cover is a planar surface.

6. The ear bud stabilizer of claim 1 wherein:

the mesh covering of the right side ear cover has an interior surface that is convex; and the mesh covering of the left side ear cover has an interior surface that is convex.

7. The ear bud stabilizer of claim 1 wherein:

the C-shaped band comprises a right side portion and a left side portion connected by a sliding coupling.

8. The ear bud stabilizer of claim 1 wherein:

the right side ear cover and the left side ear cover are attached to the C-shaped band via pivoting couplings.

9. An ear bud stabilizer comprising:

a substantially C-shaped band having an inner surface, an outer surface a right side end and a left side end;

a right side ear cover extending from the right side end;

said right side ear cover comprising a curved frame defining an opening with single layer of exposed mesh covering extending from the curved frame over the opening to allow for unimpeded air flow through the single layer of exposed mesh covering;

a left side ear cover extending from the left side end;

said left side ear cover comprising a curved frame defining an opening with single layer of exposed mesh covering extending from the curved frame over the opening to allow for unimpeded air flow through the single layer of exposed mesh covering; and the C-shaped band comprises a right side portion and a left side portion connected by a sliding coupling.

10. The ear bud stabilizer of claim 9 wherein:

the C-shaped band is constructed from a resilient material that pushes the right side ear cover and the left side ear cover toward each other.

11. The ear bud stabilizer of claim 9 wherein:

the curved frame of the right side ear cover is a closed frame; and the curved frame of the left side ear cover is a closed frame.

12. The ear bud stabilizer of claim 9 wherein:

the curved frame of the right side ear cover is an open frame; and the curved frame of the left side ear cover is an open frame.

13. The ear bud stabilizer of claim 9 wherein:

the mesh covering of the right side ear cover is a planar surface; and the mesh covering of the left side ear cover is a planar surface.

14. The ear bud stabilizer of claim 9 wherein:

the mesh covering of the right side ear cover has an interior surface that is convex; and the mesh covering of the left side ear cover has an interior surface that is convex.

15. The ear bud stabilizer of claim 9 wherein:

the right side ear cover and the left side ear cover are attached to the C-shaped band via pivoting couplings.

16. A method for stabilizing a pair of ear buds within an individual's ears using an ear bud stabilizer wherein said ear bud stabilizer comprises a substantially C-shaped band having an inner surface, an outer surface a right side end and a left side end, a right side ear cover extending from the right side end, said right side ear cover comprising a curved frame defining an opening with single layer of exposed mesh covering extending from the curved frame over the opening to allow for unimpeded air flow through the single layer of exposed mesh covering; a left side ear cover extending from the left side end, said left side ear cover comprising a curved frame defining an opening with single layer of exposed mesh covering extending from the curved frame over the opening to allow for unimpeded air flow through the single layer of exposed mesh covering, said method comprising the steps of:

a. inserting a set of ear buds into an individual's ears;

b. the ear bud stabilizer being stretched outward from a resting position into an open position;

c. placing the mesh coverings of the right side ear cover and the left side ear cover over the ear buds and the individual's ears; and d. releasing the C-shaped band so that the C-shaped band provides an inward pressure on the ear buds, thereby preventing the ear buds from falling out of the user's ears.

* * * * *